US009072950B2

(12) United States Patent
Thomas

(10) Patent No.: US 9,072,950 B2
(45) **Date of Patent: *Jul. 7, 2015**

(54) FAIRWAY WOOD-TYPE GOLF CLUBS WITH HIGH MOMENT OF INERTIA

(71) Applicant: NIKE, Inc., Beaverton, OR (US)

(72) Inventor: James S. Thomas, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/046,434

(22) Filed: Oct. 4, 2013

(65) Prior Publication Data

US 2014/0038748 A1 Feb. 6, 2014

Related U.S. Application Data

(63) Continuation of application No. 13/651,804, filed on Oct. 15, 2012, which is a continuation of application No. 12/622,223, filed on Nov. 19, 2009, now Pat. No. 8,287,400.

(51) Int. Cl.

| | |
|---|---|
| ***A63B 53/10*** | (2006.01) |
| ***A63B 53/12*** | (2006.01) |
| ***A63B 53/04*** | (2006.01) |

(52) U.S. Cl.

CPC ..... *A63B 53/0466* (2013.01); *A63B 2053/0408* (2013.01); *A63B 2053/0412* (2013.01); *A63B 2053/0416* (2013.01); *A63B 2053/0433* (2013.01); *A63B 2053/0458* (2013.01); *A63B 2209/023* (2013.01)

(58) Field of Classification Search

CPC ..... A63B 53/0466; A63B 2053/0408; A63B 2053/0412; A63B 2053/0416; A63B 2053/0433; A63B 2053/0458; A63B 2209/023

USPC ..... 473/287–292, 324–350, 316

See application file for complete search history.

(56) References Cited

U.S. PATENT DOCUMENTS

| | | | |
|---|---|---|---|
| 3,761,095 | A | 9/1973 | Thompson |
| 4,280,700 | A | 7/1981 | Plagenhoef |
| 4,319,752 | A | 3/1982 | Thompson |
| 5,042,806 | A | 8/1991 | Helmstetter |

(Continued)

FOREIGN PATENT DOCUMENTS

| | | | |
|---|---|---|---|
| CN | 1463195 | A | 12/2003 |
| CN | 101060892 | A | 10/2007 |

(Continued)

OTHER PUBLICATIONS

Office Action, U.S. Appl. No. 12/622,223, dated Feb. 2, 2012.

(Continued)

*Primary Examiner* — Sebastiano Passaniti

(74) *Attorney, Agent, or Firm* — Banner & Witcoff, Ltd.

(57) ABSTRACT

Fairway wood-type golf clubs as described herein may include: (a) a club head with a volume of at least 300 cc; (b) a shaft member attached to the club head, wherein the golf club has a length between 37 and 43 inches; and (c) a grip or handle member attached to the shaft member. The club head may further include: (1) a ball striking face, wherein the ball striking face has a loft angle between 12 and 32 degrees; and (2) a club head body engaged or integrally formed with the ball striking face, with a sole portion that includes a ground-engaging surface.

22 Claims, 8 Drawing Sheets

(56) References Cited

U.S. PATENT DOCUMENTS

| | | | | |
|---|---|---|---|---|
| 5,092,599 | A | 3/1992 | Okumoto et al. | |
| 5,377,983 | A | 1/1995 | Fenton | |
| 5,611,741 | A | 3/1997 | Schmidt et al. | |
| 5,779,565 | A | 7/1998 | Adams | |
| 5,788,584 | A | 8/1998 | Parente et al. | |
| 5,916,038 | A * | 6/1999 | Uchiyama et al. | 473/290 |
| D422,659 | S | 4/2000 | Mertens | |
| 6,120,389 | A | 9/2000 | Kruse | |
| 6,251,029 | B1 | 6/2001 | Roberts | |
| 6,332,848 | B1 | 12/2001 | Long et al. | |
| 6,447,405 | B1 | 9/2002 | Chen | |
| 6,863,624 | B1 | 3/2005 | Kessler | |
| 6,887,165 | B2 | 5/2005 | Tsurumaki | |
| 7,163,468 | B2 * | 1/2007 | Gibbs et al. | 473/329 |
| 7,186,190 | B1 * | 3/2007 | Beach et al. | 473/335 |
| 7,503,853 | B2 * | 3/2009 | Matsunaga | 473/345 |
| 7,559,851 | B2 * | 7/2009 | Cackett et al. | 473/300 |
| 7,674,189 | B2 * | 3/2010 | Beach et al. | 473/345 |
| 8,052,541 | B2 | 11/2011 | Ross | |
| 8,070,621 | B2 * | 12/2011 | Nakano | 473/290 |
| 8,133,135 | B2 * | 3/2012 | Stites et al. | 473/342 |
| 8,221,260 | B2 * | 7/2012 | Stites et al. | 473/324 |
| 8,235,841 | B2 * | 8/2012 | Stites et al. | 473/328 |
| 8,287,400 | B2 * | 10/2012 | Thomas | 473/316 |
| 8,550,935 | B2 * | 10/2013 | Stites et al. | 473/324 |
| 2003/0153401 | A1 | 8/2003 | Helmstetter et al. | |
| 2004/0009830 | A1 | 1/2004 | Nishio | |
| 2004/0116200 | A1 * | 6/2004 | Helmstetter et al. | 473/291 |
| 2005/0181887 | A1 | 8/2005 | Sano et al. | |
| 2006/0293120 | A1 | 12/2006 | Cackett et al. | |
| 2007/0099727 | A1 * | 5/2007 | Sugimoto | 473/345 |
| 2009/0048035 | A1 | 2/2009 | Stites et al. | |
| 2010/0234126 | A1 | 9/2010 | Cackett et al. | |
| 2011/0021284 | A1 | 1/2011 | Stites et al. | |

FOREIGN PATENT DOCUMENTS

| | | | |
|---|---|---|---|
| JP | H07-185047 | A | 7/1995 |
| JP | 07284546 | A | 10/1995 |
| JP | 2002-177416 | A | 6/2002 |
| JP | 2004-008345 | A | 1/2004 |
| JP | 2007-082752 | A | 4/2007 |
| WO | 2008157691 | A2 | 12/2008 |

OTHER PUBLICATIONS

ISR, PCT/US2010/051797, dated Feb. 22, 2011.
Office Action, Japanese SN 2012-539910, dated Oct. 23, 2013.
Oct. 9, 2014 (EP) Office Action—Application 10765916.1.
Office Action Dated Feb. 8, 2014 in Chinese Application No. 201080060651.
Office Action Dated Jun. 23, 2014 in Japanese Application 2012-539910.

* cited by examiner

FAIRWAY WOOD-TYPE GOLF CLUBS WITH HIGH MOMENT OF INERTIA

This Application is a continuation of U.S. application Ser. No. 13/651,804 filed Oct. 15, 2012, which is a continuation of U.S. application Ser. No. 12/622,223 filed Nov. 19, 2009, now U.S. Pat. No. 8,287,400, issued Oct. 16, 2012 wherein the entire disclosure of each application is herein incorporated by reference.

FIELD OF THE INVENTION

This invention relates generally to golf clubs, specifically fairway "wood-type" golf clubs. Additional aspects of this invention relate to methods for making such golf clubs, particularly fairway wood-type golf clubs that include a high moment of inertia.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Despite recent technological advances, fairway "wood-type" golf clubs can be very difficult for some players to hit consistently well. Accordingly, additional technological advances that improve a player's ability to get a golf ball airborne; increase ball flight distance, direction, and/or control; and/or otherwise improve the playability of fairway wood-type golf clubs would be welcome in the golf world.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In general, aspects of this invention relate to fairway wood-type golf clubs. Fairway wood-type golf clubs in accordance with at least some examples of this invention may include one or more of the following: a club head, a hosel member engaged or integrally formed with at least a portion of the club head, and a shaft member engaged with the hosel member. The club head may include a club head body with heel, toe, crown, sole, and rear portions; and a ball striking face engaged with or integrally formed as part of the club head body, wherein the ball striking face extends from the toe portion to the heel portion. The golf club may have a length between 37 and 43 inches. (golf club length as described throughout this application refers to the overall club length as measured in Appendix II of the Rules of Golf). The ball striking face may include a loft angle (defined as an angle of the ball striking face in relation to the shaft member) between 12 and 32 degrees. Additionally, the loft angle may be between 15 and 20 degrees. The club head may have a volume of at least 300 cc (and in some examples, within the range of 300 to 400 cc, inclusive). Additionally, the club head may have a volume of at least 400 cc or 460 cc. The sole portion may include a ground-engaging surface. The ground-engaging surface may include a keel positioned along a center of the sole portion and extending rearward from a bottom edge of the ball striking face toward the rear portion of the club head opposite the ball striking face. The keel may have a substantially smooth curvilinear surface. Alternatively, the keel may have a plurality of substantially smooth, substantially planar surfaces oriented at transverse angles to each other. In a second embodiment, the ground-engaging surface may include a front surface adjacent to the ball striking face, a central surface, and a rear surface adjacent to the rear portion of the club head. The front surface may be angled upward in the direction toward the ball striking face. The central surface may be generally horizontal and parallel to the ground surface. The rear surface may be angled upward in the direction toward the rearmost point or edge of the club head body. Additionally, the ground-engaging surface may include a low point near the center surface, with the ground-engaging surface angled upward from the low point in both the heel portion direction and the toe portion direction Additional example fairway wood-type golf clubs according to this invention may include one or more of the following: (a) a club head body including heel, toe, crown, sole, and rear portions, wherein the rear portion includes at least one increased weight zone, and the sole portion includes a ground-engaging surface; (b) a variable thickness ball striking face engaged with or integrally formed as part of the club head body (the ball striking face being located remote from one increased weight zone and extending from the club head's toe portion to the heel portion), wherein the ball striking face includes a loft angle between 12 and 32 degrees; (c) a shaft member engaged with the club head, wherein the golf club has a length between 37 and 43 inches. The club head body parts and increased weight zone(s) in at least some example structures according to this invention will be arranged such that the club head has a moment of inertia about a vertical axis passing through the club head center of gravity when the club head is at a ball address position (also called "Izz" herein) of at least 5000 g-cm$^2$. The club head body may have a volume of at least 300 cc.

Additional example fairway wood-type golf clubs according to this invention may include one or more of the following: (a) a cup face member including a ball striking face portion (optionally with a variable face thickness), wherein the striking face portion includes a loft angle between 12 and 23 degrees, and a return portion; (b) a first body member (e.g., a sole portion, wherein the sole portion includes a ground-engaging surface) engaged with the return portion; (c) a second body member (e.g., a crown portion) engaged with the return portion; (d) a third body member (e.g., a rear portion) engaged with at least one of the first body member and the second body member, wherein the second body member is located between and separates at least some portion of the third body member from the return portion; (e) one or more weight members engaged or integrally formed with at least one of the first body member and the third body member (e.g., located at a rear area of the club head structure); (f) a hosel member engaged or integrally formed with at least one of the cup face member and the second body member; and (g) a shaft member engaged with the hosel member, wherein the golf club has a length less than 43 inches. The club head body may have a volume of at least 300 cc. In some club head structures according to the invention, the club head will consist essentially of the parts identified above.

Methods of making fairway wood-type golf clubs in accordance with at least some examples of this invention may include, for example: (a) providing a ball striking face member having a variable ball striking face thickness; (b) engaging a club head body with the ball striking face member, wherein the club head body may be one of the types generally described above; (c) engaging a shaft member with the golf club head; wherein the golf club has a length between 37 and 43 inches and/or (d) engaging a grip member with the shaft member. Additional methods of making golf clubs in accordance with at least some examples of this invention may include one or more of the following: (a) forming a cup face member including a ball striking face portion and a return portion extending from a perimeter area of the ball striking face portion; (b) engaging a first body member with the return portion, wherein the first body member includes at least part of a sole portion of the golf club head; (c) engaging a second body member with the return portion, wherein the second body member includes at least part of a crown portion of the golf club head; (d) engaging a third body member with at least one of the first body member and the second body member, wherein the third body member is engaged so as to extend across a portion of a rear area of the golf club head from a heel side toward a toe side of the club head, and wherein the second body member is included in the club head structure so as to be located between at least some portion of the third body member and the return portion; (e) engaging a weight member with at least one of the first body member and the third body member, wherein the weight member is engaged proximate the rear portion of the golf club head; (f) engaging the first body member with the second body member; (g) engaging a hosel member with at least one of the cup face member, the first body member, and/or the second body member; (h) engaging a shaft member with the golf club head; wherein the golf club has a length between 37 and 43 inches and/or (i) engaging a grip member with the shaft member.

BRIEF DESCRIPTION OF THE DRAWINGS

A more complete understanding of the present invention and certain advantages thereof may be acquired by referring to the following detailed description in consideration with the accompanying drawings, in which.

Figure 1:
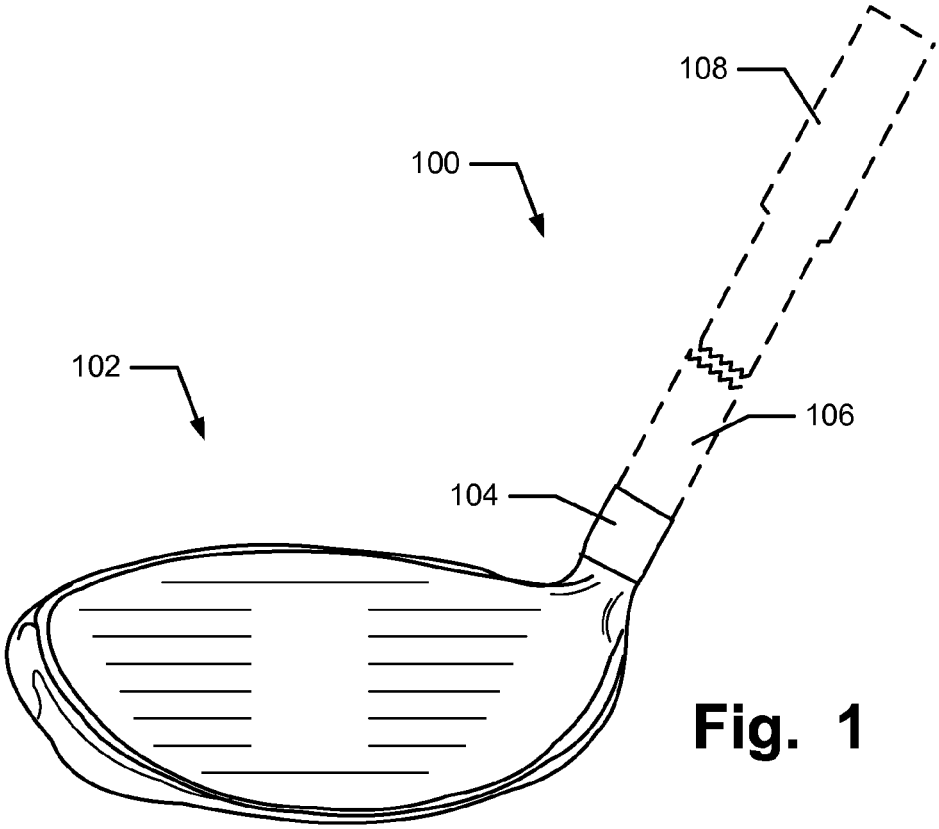
FIG. 1 illustrates a front view of an example fairway wood-type golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Fairway Wood-Type Golf Clubs According to Examples of the Invention In general, as described above, aspects of this invention relate to fairway wood-type golf clubs, (such as fairway woods), as well as to methods of making and using such clubs. Fairway wood-type golf clubs according to at least some example aspects of this invention may include: (a) a club head with a volume of at least 300 cc; (b) a shaft member, wherein the golf club has a length between 37 and 43 inches, the shaft member attached to the club head (optionally via a separate hosel member or a hosel member provided as a part of one or more of the club head and/or shaft); and (c) a grip or handle member attached to the shaft member. The club head may further include: (1) a ball striking face, wherein the ball striking face has a loft angle between 12 and 32 degrees; and (2) a club head body engaged or integrally formed with the ball striking face, with a sole portion that includes a ground-engaging surface.

The wood-type golf club head body may take on a variety of forms without departing from this invention. For example, the club head body may be made from any desired number of different parts, of any desired construction, from any desired materials, etc., without departing from this invention, including from conventional parts, of conventional constructions, and/or from conventional materials as are known and used in the art. In some example structures, the club head body will include one or more of the following parts: a crown portion, a sole portion with a ground-engaging surface, a face member (optionally including a ball striking face integrally formed therein or attached thereto), one or more body ribbons (e.g., forming or defining the periphery of the club head between the crown and sole portions), a sole plate, a frame member (optionally of metal, such as titanium alloys or the like, e.g., forming or defining the periphery of the club head between the crown and sole portions and/or to which one or more of the crown portion and/or the sole portion (if present) are engaged, etc.), an aft body, etc. The club head body may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, etc.). As yet another example, if desired, the club head body may have a unitary one piece construction, optionally with the frame member integrally formed therein, and further with a separate removable weight portion (and optionally a separate weight insert, if desired) engaged therewith. Any desired structure and/or arrangement of the club head body structure and/or its various parts may be used without departing from this invention.

Additional example fairway wood-type golf clubs in accordance with at least some examples of this invention include: (a) a club head with a volume of at least 300 cc; (b) a shaft member, wherein the golf club has a length between 37 and 43 inches, the shaft member attached to the club head (optionally via a separate hosel member or a hosel member provided as a part of one or more of the club head and/or shaft); and (c) a grip or handle member attached to the shaft member. The club head may include: (1) a club head body having a heel portion, a toe portion, a crown portion, a sole portion with a ground-engaging surface, and a rear portion, wherein the rear portion includes a first increased weight zone; and (2) a variable thickness ball striking face with a loft angle between 12 and 32 degrees, wherein the ball striking face is engaged with or integrally formed as part of the club head body, and the ball striking face is located at a portion of the club head body remote from the first increased weight zone and extends from the toe portion to the heel portion. The club head may have a moment of inertia about a vertical axis passing through the club head center of gravity with the club head at a ball address orientation (also called "Izz" herein) of at least 5000 g-cm$^2$. Furthermore, the club head may have a volume of at least 400 cc, a club head length dimension (in the heel-to-toe direction) of at least 4.5 inches, and a ratio of the club head length dimension to an overall breadth dimension (from front to back) of at least 0.92.

Additional example fairway wood-type golf clubs in accordance with at least some examples of this invention include: (a) a club head with a volume of at least 300 cc; (b) a shaft member, wherein the golf club has a length between 37 and 43 inches, the shaft member attached to the club head (optionally via a separate hosel member or a hosel member provided as a part of one or more of the club head and/or shaft); and (c) a grip or handle member attached to the shaft member. The club head may include one or more of the following: (1) a cup face member including a ball striking face portion and a return portion extending from a perimeter area of the ball striking face portion, the ball striking face portion having a loft angle between 12 and 32 degrees; (2) a first body member engaged with the return portion, the first body member including at least part of a sole portion of the golf club head, the sole portion including a ground-engaging surface; (3) a second body member engaged with the return portion, the second body member including at least part of a crown portion of the golf club head; (4) a third body member engaged with at least one of the first body member and the second body member, wherein the third body member extends across at least part of a rear portion of the golf club head in a direction from a heel side toward a toe side of the club head, and wherein the second body member is located between and separates at least some portion of the third body member from the return portion; (5) a weight member engaged with at least one of the first body member and the third body member, wherein the weight member is located proximate the rear portion of the golf club head; and/or (6) a hosel member engaged or integrally formed with at least one of the cup face member, the first body member, and/or the second body member. If desired, the first body member may be engaged with the second body member.

The club head body may be made from a wide variety of materials and parts without departing from this invention, including in conventional ways, from conventional materials and parts, as are known and used in the art. In some more specific examples, parts of the club head may be made from one or more of: metal materials (e.g., metals, such as titanium, magnesium, aluminum, etc.); or metal alloys, such as alloys of steel; alloys containing titanium, magnesium, or aluminum; etc.); composite materials (e.g., carbon fiber composites, basalt fiber composites, etc., for a crown portion, a skirt portion, a sole portion, an aft body portion, a ball striking face portion, etc.); polymeric materials; etc.

If desired, at least some or even all of the club head body and/or the ball striking face of the club head may be made from titanium metal and/or titanium based alloy materials. In some more specific examples, at least 50% of the mass, volume, and/or surface area of the club head body and/or the entire club head will be made from titanium metal and/or titanium based alloy materials, and in some example structures, these amounts may be at least 75%, at least 85%, at least 90%, or even at least 95%. The moment of inertia (Izz) of club head structures in accordance with at least some examples of this invention (as conventionally measured in the art) may be quite high, including, for example: at least 4000 g-cm$^2$, at least 4200 g-cm$^2$, at least 4500 g-cm$^2$, at least 5000 g-cm$^2$, or even at least 5900 g-cm$^2$.

The specific features of club heads in accordance with examples of this invention may vary widely. For example, a club head may have a club head length dimension (in the heel-to-toe direction) of at least 4.75 inches, or even at least 4.8 inches, 4.9 inches or more. The club head volume also may vary, including volumes of at least 420 cc, at least 450 cc, or even 460 cc or more. The ratio of the overall length dimension to an overall breadth dimension of the club head (in the face-to-rear direction) may be at least 0.94, at least 0.96, at least 0.98, or even more.

Fairway wood-type golf clubs in accordance with examples of this invention may include additional features. For example, in an aspect of this invention, the sole may be configured to confront and engage the playing surface in use. With clubs that are configured to hit a ball resting directly on the playing surface, such as a fairway wood, the sole may contact the playing surface in use, and features of the club may be designed accordingly. The sole may comprise a ground-engaging surface that includes a keel positioned along a center of the sole and extending rearward from a bottom edge of the face toward a rear of the head opposite the face. The keel may be configured to be a lowest surface of the head in use, and at least a portion of the keel may be raised with respect to adjacent surfaces. Additionally, the keel may have a substantially smooth curvilinear surface. In another example, the keel may have a plurality of substantially smooth, substantially planar surfaces oriented at transverse angles to each other.

Fairway wood-type golf clubs in accordance with examples of this invention may include additional features, if desired, including features that are known and used in the golf club art. For example, a weighting system may be permanently mounted to the club head body member, e.g., on an interior or exterior of the club head body, extending from the exterior to the interior of the club head body (e.g., through a weight port), etc. As yet additional examples, if desired, the weighting system may include one or more weight member (s) that are movably and/or removably mounted with respect to the club head body member, e.g., using structures and techniques that are known and used in the art (e.g., by screw, set screw, or other mechanical connector attachments, by sliding attachments, etc.). Advantageously, in accordance with at least some examples of this invention, the weighting system will include weight members located at or proximate to a rear of the club head body member, optionally with weight members provided toward the rear toe, the rear heel, and/or the rear sole portions of the club head. If desired, at least some portions of the weighting system may be selectively movable and/or removable from the club head body member and/or mountable in a variety of different positions and/or arrangements, e.g., to allow customization, interchange, replacement, and/or club-fitting (e.g., to provide a draw biased club, to provide a fade biased club, to provide a high trajectory biased club, to provide a low trajectory biased club, to provide a club to help compensate for undesired ball flights or swing flaws (e.g., to help correct hooks, slices, etc., to help get balls airborne, to help prevent ballooning ball flights, etc.), etc.).

Various features of the club head body part(s) may help reduce or "save" additional weight to enable selective positioning of discretionary weight in the club head structure to increase the club head's moment of inertia and/or otherwise alter its characteristics. For example, the crown portion and/or the sole portion of the club head may include a central area and a perimeter area, wherein the central area is made thinner than the perimeter area. Likewise, the ball striking face may be thinned around its perimeter (to thereby provide the variable thickness ball striking face). The mass "saved" due to the reduced thickness areas of the crown portion, sole portion, and/or ball striking face portion then may be "repositioned" in the club head structure to increase the moment of inertia of the club head, to affect ball flight characteristics (e.g., to bias the club for certain desired types of ball flights, as mentioned above), and/or to help compensate for user swing flaws.

Fairway wood-type golf clubs in accordance with examples of this invention may include still additional features, if desired, including features that are known and used in the golf club art. For example, the fairway wood-type golf clubs may include systems and methods for connecting golf club heads to shafts in a releasable manner so that the club heads and shafts can be readily interchanged and/or so that the angle and/or position of the shaft with respect to the club head body (and its ball striking face) can be readily changed. The club head and shaft may be interchanged with respect to one another by releasing the securing system and interchanging the originally present parts (e.g., shafts, club heads, etc.) with different parts having different characteristics. Additionally or alternatively, the shaft may be angled and/or the chamber for receiving the shaft in the shaft engaging member may be angled with respect to the axial direction of the club head hosel or club head engaging member so as to allow adjustment of the angle or position of the shaft with respect to the club head (e.g., with respect to its ball striking face) by rotating the shaft engaging member with respect to the club head body. In such structures, the shaft can be quickly and easily exchanged for a different shaft on the club head body (e.g., a shaft of different length, different flex characteristics, different material, different mass, etc.). Additionally or alternatively, if desired, in such structures, the club head can be quickly and easily exchanged for a different one on the shaft (e.g., a club head of different loft, lie angle, size, brand, etc.).

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

B. General Description of Example Methods of Making and/or Using Fairway Wood-Type Golf Clubs According to the Invention Additional aspects of this invention relate to methods of making fairway wood-type golf club structures in accordance with this invention. Such methods may include, for example, one or more of the following steps: (a) providing a ball striking face, wherein the ball striking face has a loft angle between 12 and 32 degrees; (b) engaging a club head body with the ball striking face, wherein the club head body includes a heel portion, a toe portion, a crown portion, a sole portion, and a rear portion; wherein the club head has a volume of at least 300 cc; wherein the sole portion has a ground-engaging surface; (c) engaging a shaft member with the golf club head; wherein the golf club has a length between 37 and 43 inches and/or (d) engaging a grip member with the shaft member.

Additional aspects of this invention relate to methods of making fairway wood-type golf club structures in accordance with this invention (e.g., of the various types described above). Such methods may include, for example, one or more of the following steps: (a) providing a ball striking face having a variable ball striking face thickness, wherein the ball striking face has a loft angle between 12 and 32 degrees; (b) engaging a club head body with the ball striking face, wherein the club head body includes a heel portion, a toe portion, a crown portion, a sole portion with a ground-engaging surface, and a rear portion; wherein the rear portion includes a first increased weight zone; wherein the ball striking face is located at a portion of the club head body remote from the first increased weight zone and extends at least partially in a direction from the toe portion toward the heel portion; wherein the club head has a moment of inertia Izz of at least 5000 g-cm$^2$; wherein the club head has a volume of at least 300 cc; wherein the club head has an overall length dimension (in the heel-to-toe direction) of at least 4.5 inches; and wherein the club head has a ratio of the overall length dimension to an overall breadth dimension (in the face-to-rear direction) of at least 0.92; (c) engaging a shaft member with the golf club head, wherein the golf club has a length between 37 and 43 inches; and/or (d) engaging a grip member with the shaft member. Such fairway wood-type golf clubs may have any of the desired characteristics described in the sub-section above.

Additional methods of making fairway wood-type golf clubs in accordance with at least some examples of this invention may include one or more of the following: (a) forming a cup face member including a ball striking face portion and a return portion extending from a perimeter area of the ball striking face portion, wherein the ball striking face portion includes a loft angle between 12 and 32 degrees; (b) engaging a first body member with the return portion, wherein the first body member includes at least part of a sole portion of the golf club head, the sole portion includes a ground-engaging surface; (c) engaging a second body member with the return portion, wherein the second body member includes at least part of a crown portion of the golf club head; (d) engaging a third body member with at least one of the first body member and the second body member, wherein the third body member is engaged so as to extend across at least part of a rear portion of the golf club head in a direction from a heel side toward a toe side of the club head, and wherein the second body member is engaged so as to be located between at least some portion of the third body member and the return portion; (e) engaging a weight member with at least one of the first body member and the third body member, wherein the weight member is engaged proximate the rear portion of the golf club head; (f) engaging the first body member with the second body member; (g) engaging a hosel member with at least one of the cup face member, the first body member, and/or the second body member; (h) engaging a shaft member with the golf club head, wherein the golf club has a length between 37 and 43 inches and the golf club head has a volume of at least 300 cc; and/or (i) engaging a grip member with the shaft member. Again, such golf clubs and golf club heads may have any of the desired characteristics described above.

As noted above, various individual parts of the club head body and/or the ball striking face may be made with different thicknesses (e.g., a thicker center portion for the ball striking face, a thicker perimeter portion for the crown and/or sole members, etc.). This change in thickness may be accomplished in any desired manner without departing from this invention. In some more specific examples, various desired portions of the club head body and/or the ball striking face may be made thinner by milling or machining processes, including chemical milling processes.

The various parts of the golf club and the club head may be engaged together in any desired manner. As some more specific examples, the various "engaging" steps described above may include one or more of: bonding using adhesives or cements; engaging using welding, brazing, soldering, or other fusing techniques; attachment using mechanical connectors (such as screws, bolts, nuts, or the like); and the like. If desired, in some more specific example structures according to this invention, the various parts of the club head structure may be welded together.

Golf clubs according to at least some examples of this invention may be produced by engaging a shaft member and/or a handle member with the club head body (e.g., of the types described above). This may be accomplished in any desired manner, including in conventional manners that are well known and used in the art (e.g., via cements or adhesives, via mechanical connectors, etc.). Additionally, if desired, a grip element may be engaged with the shaft or handle member, e.g., in any desired manner, including in conventional manners that are well known and used in the art (e.g., via cements or adhesives, via mechanical connectors, etc.). Golf club heads and golf clubs in accordance with this invention may be used in conventional ways as also are known in the art.

Specific examples of the invention are described in more detail below. The reader should understand that these specific examples are set forth merely to illustrate examples of the invention, and they should not be construed as limiting the invention.

C. Specific Examples of the Invention

Figure 2:
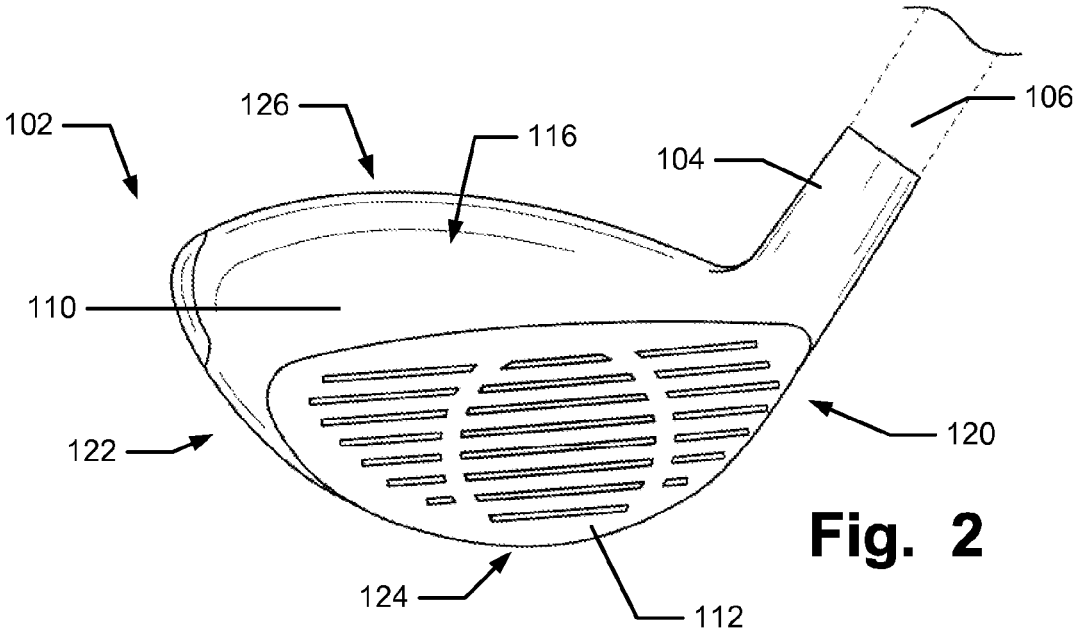
FIG. 2 illustrates a front perspective view the example fairway wood-type golf club of FIG. 1.

FIGS. 1 and 2 generally illustrate an example fairway wood-type golf club 100 in accordance with at least some examples of this invention. As is conventional, the fairway wood-type golf club 100 includes a club head 102, a hosel region 104 that connects the club head 102 to a shaft 106, and a grip member 108 engaged with the shaft 106. Various example features and aspects of the club head structure 102 will be described in more detail below in conjunction with the remaining figures. The club head 102 may be engaged with the shaft 106 via a hosel element 104 in any desired manner, including in manners that are known and used in the art (e.g., via cements or adhesives, via mechanical connections, via releasable mechanical connections, via welding, soldering, brazing, or other fusing techniques, etc.). Any desired material may be used for the shaft member 106, including conventional materials that are known and used in the art, such as steel, graphite, polymers, composite materials, combinations of these materials, etc. Likewise, the grip member 108 may be engaged with the shaft 106 in any desired manner, including in manners that are known and used in the art (e.g., via cements or adhesives, via mechanical connections, via releasable mechanical connections, etc.). Any desired material may be used for the grip member 108, including conventional materials that are known and used in the art, such as rubber, polymeric materials, cork, rubber or polymeric materials with cord or other fabric elements embedded therein, cloth or fabric, tape, etc.

The fairway wood-type golf clubs 100 shown in FIGS. 1-7D contain many common features, which are referenced by similar reference numerals in the description below. The club head 102 has a ball striking face 112 connected to a body 110. Additionally, the club head 102 generally has a top or crown 116, a bottom or sole 118, a heel 120 proximate the hosel 104, a toe 122 distal from the hosel 104, a front 124, and a back or rear 126.

In accordance with at least some examples of this invention, the length of the golf club 100 of the fairway wood-type golf clubs 100 may be in the range of 37 inches to 43 inches, such as known and used in the art for fairway woods. For example, a standard 3-wood fairway wood-type golf club may have a club length of approximately 41-43 inches, while a standard 5-wood fairway wood-type golf club may have a club length of approximately 40-42 inches and a standard 7-wood fairway wood-type club may have a club length of approximately 38-41 inches. Additionally, the club length may be increased as much as 2¼" or decreased as much as 1½" based on the height of the golfer and the wrist-to-floor measurement in order to custom fit the specific club to the golfer. The length or club length may be defined as the length as those conventional in the art have defined length, e.g., as is defined in the USGA Rules, Appendix II, Section 1.c. The USGA Rules state, "The overall length of the club must be at least 18 inches (0.457 m) and, except for putters, must not exceed 48 inches (1.219 m). For woods and irons, the measurement of length is taken when the club is lying on a horizontal plane and the sole is set against a 60 degree plane as shown in FIG. 1. The length is defined as the distance from the point of the intersection between the two planes to the top of the grip."

In accordance with at least some examples of this invention, the ball striking face 112 may generally be provided with a loft angle $\alpha$. The loft angle $\alpha$ is defined as the angle of the striking face 112 in relation to the shaft 106. Generally, the loft angle $\alpha$ is meant to affect the initial upward trajectory of the golf ball at the moment of impact. The loft angle $\alpha$ of the fairway wood-type golf clubs of the present invention may be between approximately 12 and 32 degrees, such as known and used in the art for fairway woods. Alternatively, the loft angle may be between 16 to 32 degrees, 16 to 28 degrees, 18 to 28 degrees and 18 to 26 degrees. For example, a standard 3-wood fairway wood-type golf club in accordance with the present invention may have a loft angle $\alpha$ of approximately 12-17 degrees, while a standard 5-wood fairway wood-type golf club in accordance with the present invention may have a loft angle $\alpha$ of approximately 20-23 degrees. Other fairway woods may have loft angles of up to about 32 degrees, or even possibly higher, if desired.

In accordance with at least some examples of this invention, the volume of the club head 102 of a fairway wood-type golf club may be in the range of 300-460 cc. A steel club head may have a volume closer to the lower range of 300 cc, while a titanium club head may have a volume closer to the higher range of 460 cc. For conventional fairway wood-type golf clubs, the club head 102 may have a volume in the range of 150-200 cc. In comparison, for the present invention, the club head 102 may have a volume in the range of 250-300 cc, 300-350 cc, 350-400 cc, or 400-460 cc without departing from this invention.

In an aspect of this invention, the sole 118 of the golf club head 102 may be configured to confront or engage the playing surface in use. With golf clubs that are configured to hit a ball resting directly on the playing surface, such as a fairway wood-type golf club, the sole 118 may contact the playing surface in use, and features of the golf club may be designed accordingly. The sole 118 may comprise a ground-engaging surface for fairway woods that is conventionally known and used in the art.

Figure 3A:
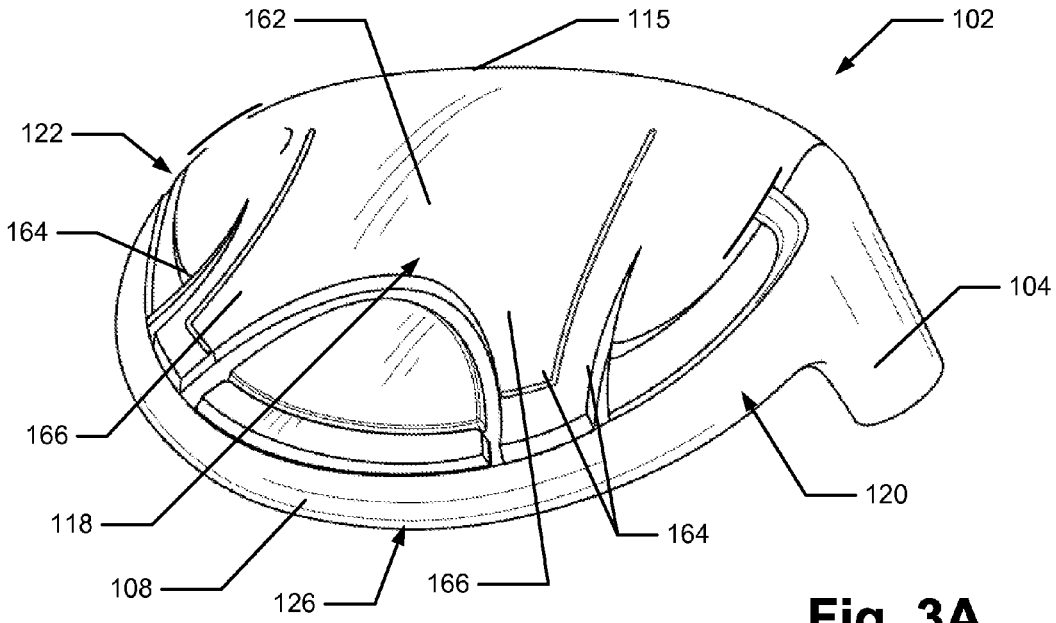
FIG. 3A illustrates a bottom perspective view of another illustrative embodiment of a fairway wood-type golf club in accordance with another example of this invention.

Additionally, as illustrated in FIGS. 3A-4C, the sole 118 may comprise a ground-engaging surface that includes a keel 162. In the embodiment illustrated in FIGS. 3A-3C, the keel 162 forms the lower extremity of the sole 118 and confronts the playing surface in use, and at least a portion of the keel 162 is raised with respect to adjacent portions of the sole 118. As shown in FIGS. 3A-3C, at least a portion of the keel 162 is defined by shoulders 164 that raise the keel 162 above the other portions of the sole 118 in contact with the shoulders 164. In this embodiment, the keel 162 slopes more gradually toward the rear 126 of the head 102 compared to adjacent portions of the sole 118, creating the shoulders 164. As also seen in FIG. 3B, the width of the keel 162 increases toward the rear 126 of the head 102, and the keel 162 splits into two legs 166 that separate further toward the rear 126 of the head 102.

Figure 3B:
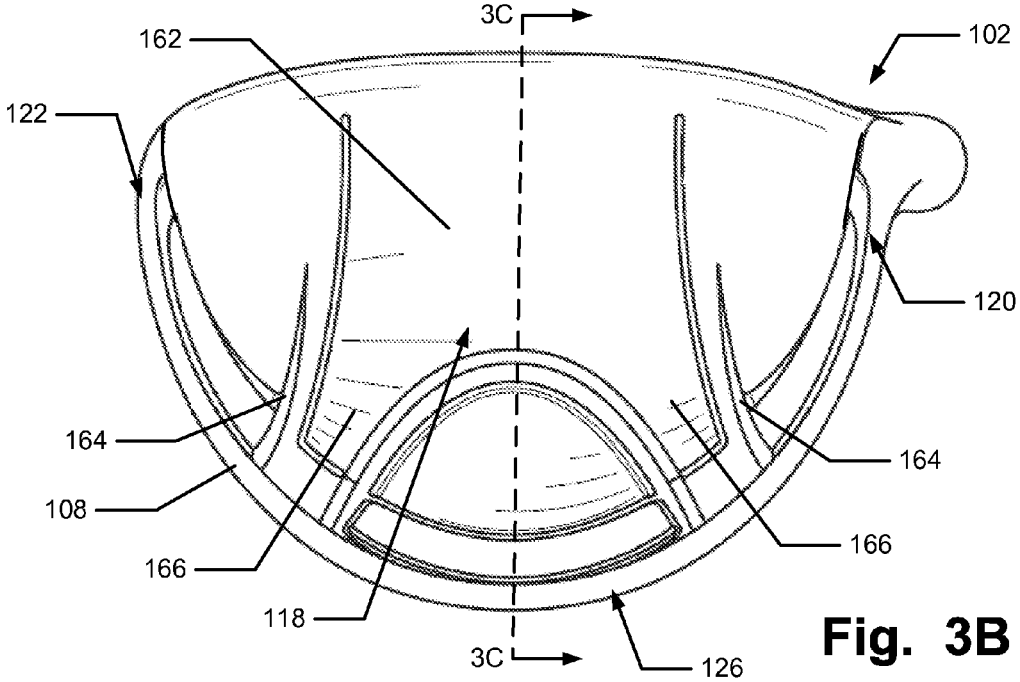
FIG. 3B illustrates a bottom view of the fairway wood-type golf club of FIG. 3A.
Figure 3C:
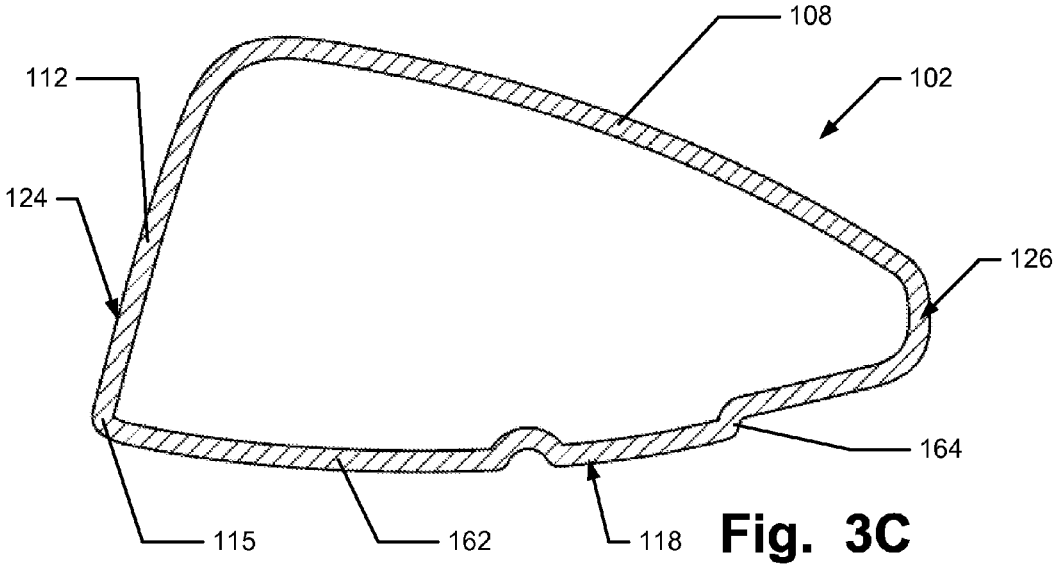
FIG. 3C illustrates a cross-section view of the fairway wood-type golf club of FIG. 3A, taken along lines 3C-3C of FIG. 3B.

Further, in this embodiment, at least a portion of the sole 118 has a substantially smooth surface. As shown in FIGS. 3A-3C, the keel 162 forms a substantially smooth surface extending from a bottom edge 115 of the face 112 toward the rear 126 of the head 102. It is understood that in this embodiment, the keel 162 has a substantially smooth curvilinear shape, as well as a substantially smooth surface texture, and that the term, "substantially smooth surface" can refer to either or both of the substantially smooth contour and surface texture of the surface. It is also understood that the substantially smooth surface may have some discontinuity, such as a logo or other marking, and still be considered substantially smooth. In this embodiment, the smooth surface of the keel 162 is polished to further increase the smoothness of the surface texture.

The smooth contour and texture of the substantially smooth surface of the keel 162 provide for decreased friction and/or other forces on the sole 118 if the sole 118 contacts the playing surface in use. Accordingly, forces on the sole 118 which may slow the speed of the head 102, alter the orientation or position of the head 102, and/or otherwise affect the swinging motion of the head 102 can be reduced appreciably. This configuration provides advantages when incorporated into the fairway wood-type golf clubs in accordance with this invention which may be used to hit a ball resting directly on a playing surface, resulting in possible contact between the sole 118 and the playing surface in use.

Figure 4C:
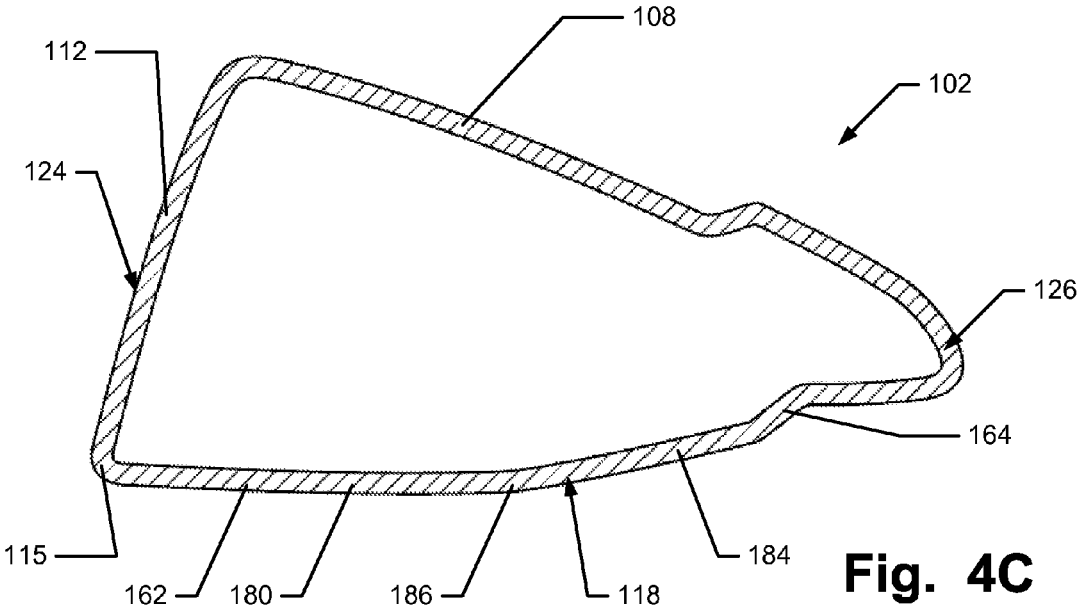
FIG. 4C illustrates a cross-section view of the fairway wood-type golf club of FIG. 4A, taken along lines 4C-4C of FIG. 4B.
Figure 4A:
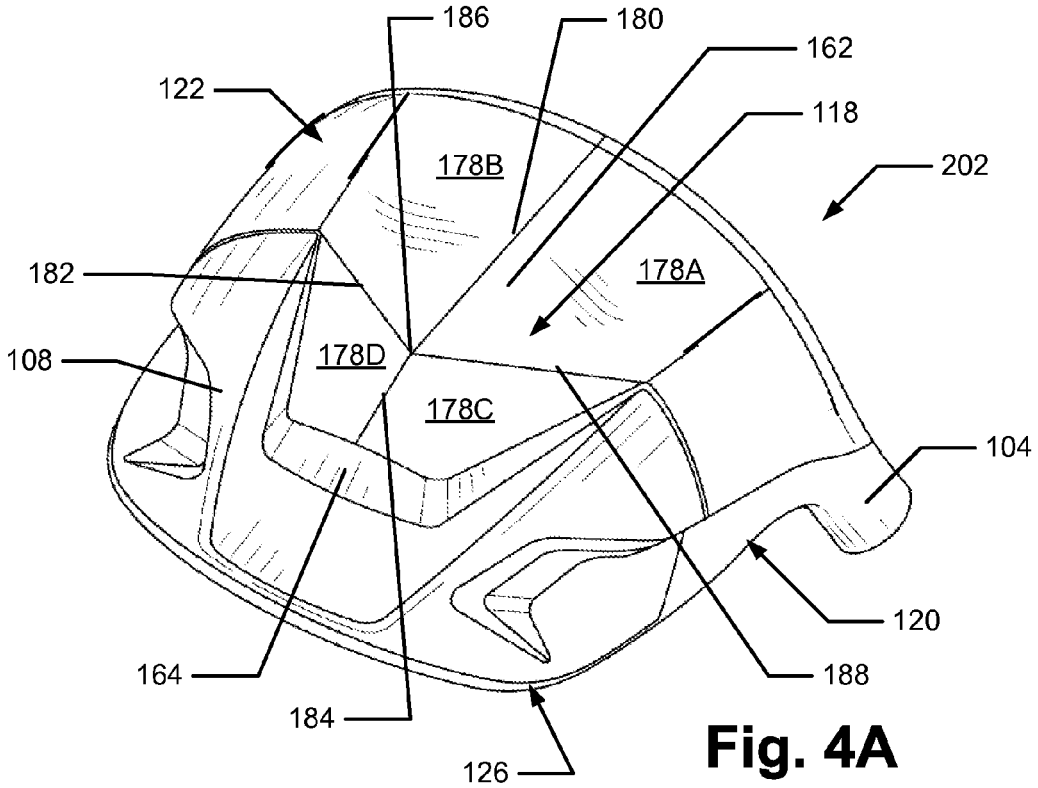
FIG. 4A illustrates a bottom perspective view of another illustrative embodiment of a fairway wood-type golf club in accordance with another example of this invention.
Figure 4B:
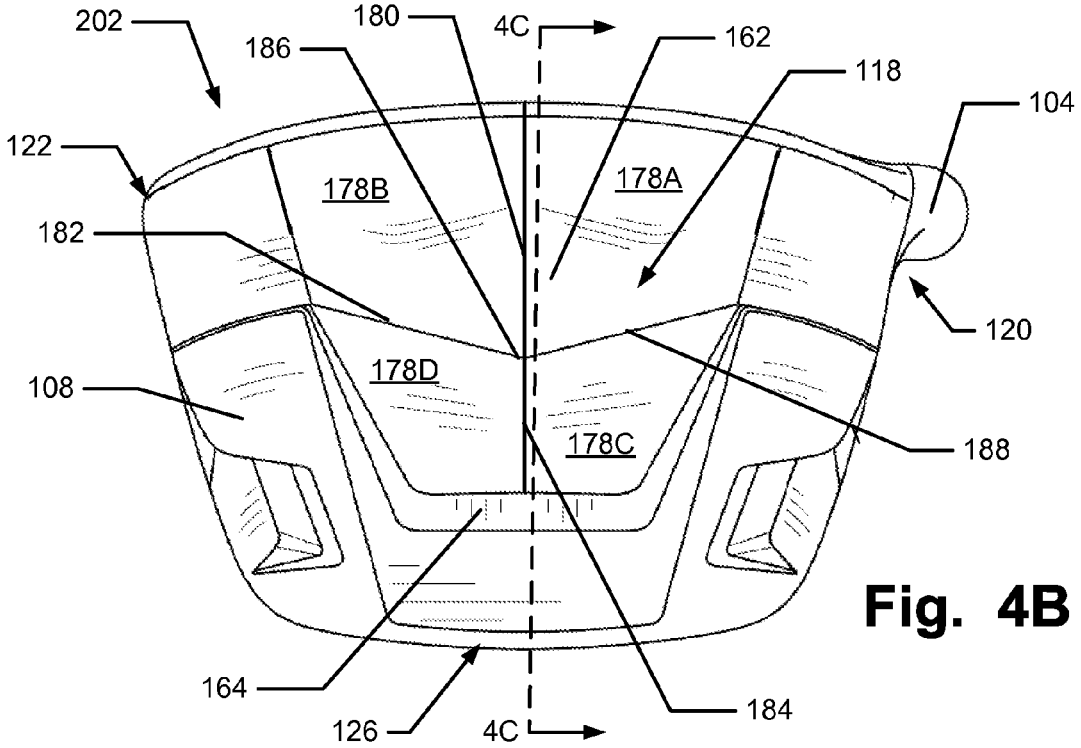
FIG. 4B illustrates a bottom view of the fairway wood-type golf club of FIG. 4A.

The fairway wood-type golf club head 202 shown in FIGS. 4A-4C includes many features in common with the golf club head 102 shown in FIGS. 3A-3C and described above, and common reference numerals are used to describe such common features. The sole 118 has a keel 162, wherein in this embodiment, the keel 162 forms the lower extremity of the sole 118 and confronts the playing surface in use, and at least a portion of the keel 162 is raised with respect to adjacent portions of the sole 118. As shown in FIGS. 4A-4C, at least a portion of the keel 162 is defined by shoulders 164 that raise the keel 162 above the other portions of the sole 118 in contact with the shoulders 164. In this embodiment, the keel 162 slopes more gradually toward the rear 126 of the head 102 compared to adjacent portions of the sole 118, creating the shoulders 164. As also seen in FIG. 3B, the width of the keel 162 decreases toward the rear 126 of the head 102.

Further, in this embodiment, at least a portion of the sole 118 is a substantially smooth surface. As shown in FIGS. 4A-4C, the keel 162 is formed of four substantially smooth, substantially planar surfaces 178A-D that are oriented at slight transverse angles to each other. Two front surfaces 178A-B extend rearward from the bottom edge 115 of the face 112 and converge to form a center ridge 180 approximately at the centerline of the sole 118. The center ridge 180 is adapted to form the lowest point on the head 102 when the golf club 200 is in use. The rear surfaces 178C-D are oriented at slight angles to each other and also at slight angles to the front surfaces 178A-B. As a result, the rear surfaces 178C-D converge with the front surfaces 178A-B to form ridges 182 extending toward the heel 120 and the toe 122 of the head, and also converge with each other to form a second center ridge 184 that is aligned with the center ridge 180. All of the ridges 180, 182, 184 extend outwardly from a convergence point 186 where all four smooth planar surfaces 178A-D converge. Thus, the keel 162 forms a substantially smooth surface extending from the bottom edge 115 of the face 112 toward the rear 126 of the head 102. As such, the keel 162 of the head 102 in FIGS. 4A-4C has a substantially smooth surface texture as well as the substantially smooth planar contour described above. As similarly described above, the smooth contour and texture of the substantially smooth surface of the keel 162 provide for decreased friction and/or other forces on the sole 118 if the sole 118 contacts the playing surface in use. Additionally, the center ridge 180 is able to glide along the playing surface, and the planar surfaces 178A-D are able to push foreign objects (e.g. grass, debris, etc.) to the sides during the swing, to reduce potential interference. Accordingly, forces on the sole 118 which may slow the speed of the head 102, alter the orientation or position of the head 102, and/or otherwise affect the swinging motion of the head 102 can be reduced appreciably.

Figure 5A:
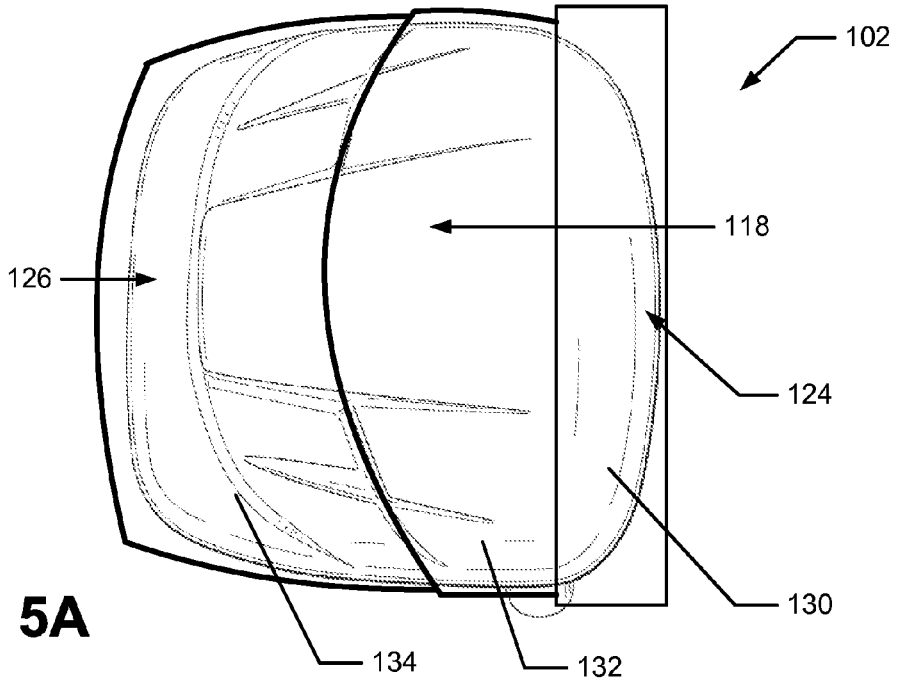
FIG. 5A illustrates a bottom view of an illustrative embodiment of a fairway wood-type golf club in accordance with another example of this invention.
Figure 5B:
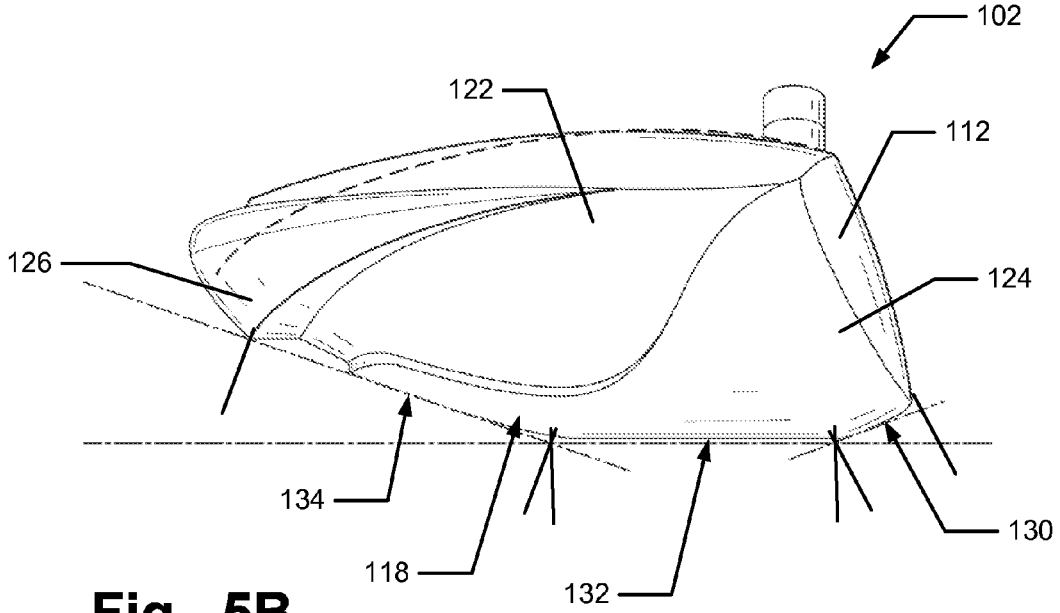
FIG. 5B illustrates a side view of the fairway wood-type golf club of FIG. 5A.

FIGS. 5A-6B illustrate an additional example ground-engaging surface in accordance with this invention. As shown in FIGS. 5A and 5B, in this example, the sole 118 has three main surfaces as one moves from the ball striking face to the rear, a front surface 130, a central surface 132, and a rear surface 134. The front surface 130 of the sole 118 is angled upward toward the lower edge of the ball striking face 112 to help avoid the fairway wood-type golf club from digging in to the turf with too much force after contact with the ball and to prevent premature contact of the sole with the ground surface. The central surface 132 of the sole 118 is generally horizontal and parallel to the ground surface. The rear surface 134 of the sole 118 is angled upward toward the rear point or edge of the club head body to help avoid contact with the turf as the fairway wood-type golf club head moves into the ball prior to contact and away from the ground after contact.

Figure 6A:
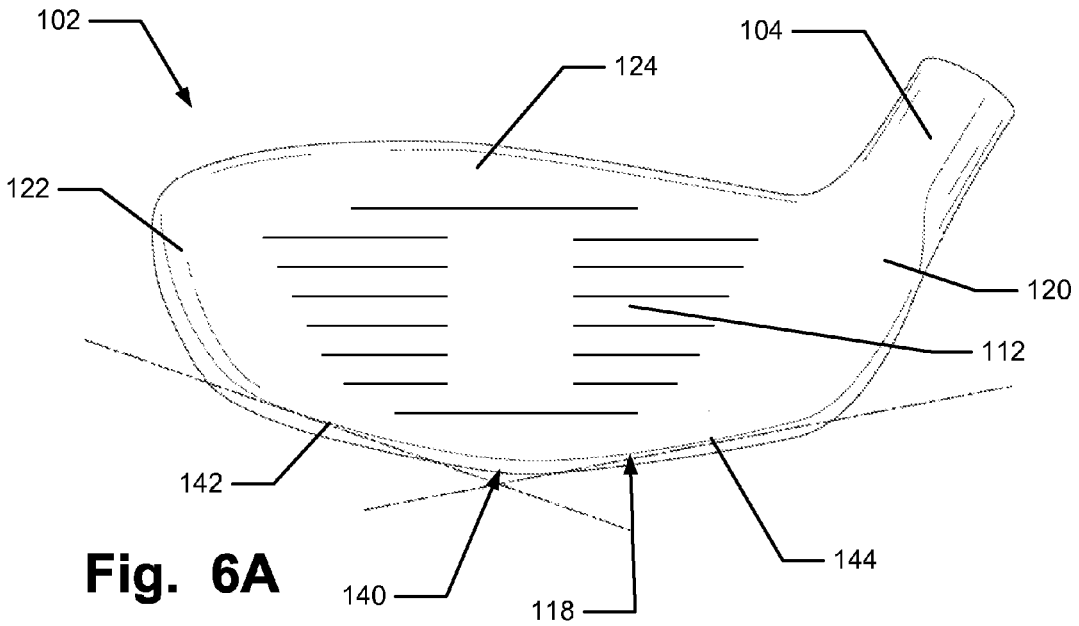
FIG. 6A illustrates a front view of the fairway wood-type golf club of FIG. 5A.
Figure 6B:
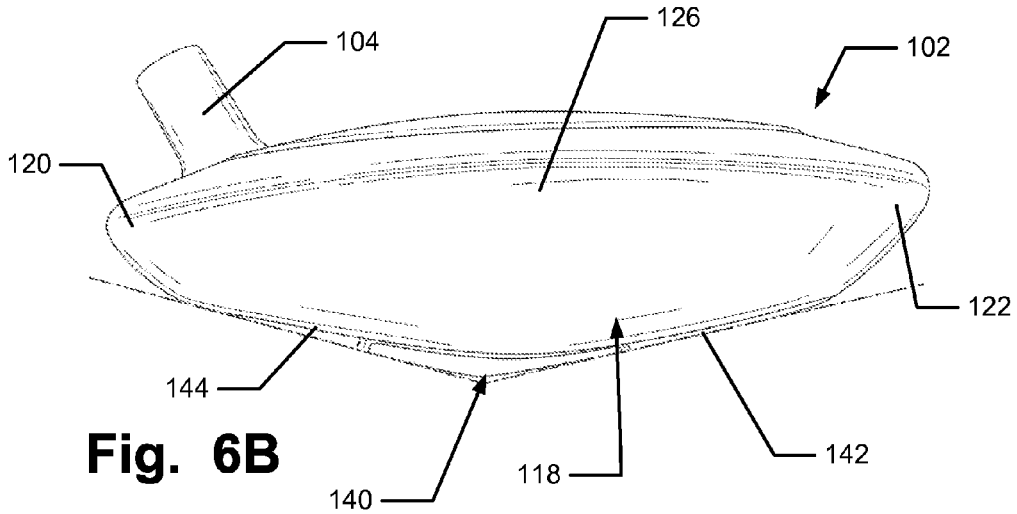
FIG. 6B illustrates a rear view of the fairway wood-type golf club of FIG. 5A.

In addition to the three main surfaces 130, 132, 134 on the sole 118, a second feature of this sole 118 is an angled surface from the heel to the toe. As shown in FIGS. 6A and 6B, the sole plate 118 reaches a low point 140 near the central surface and angles upward from this low central point 140 in both the heel 120 direction 144 and toe 122 direction 142.

Figure 7A:
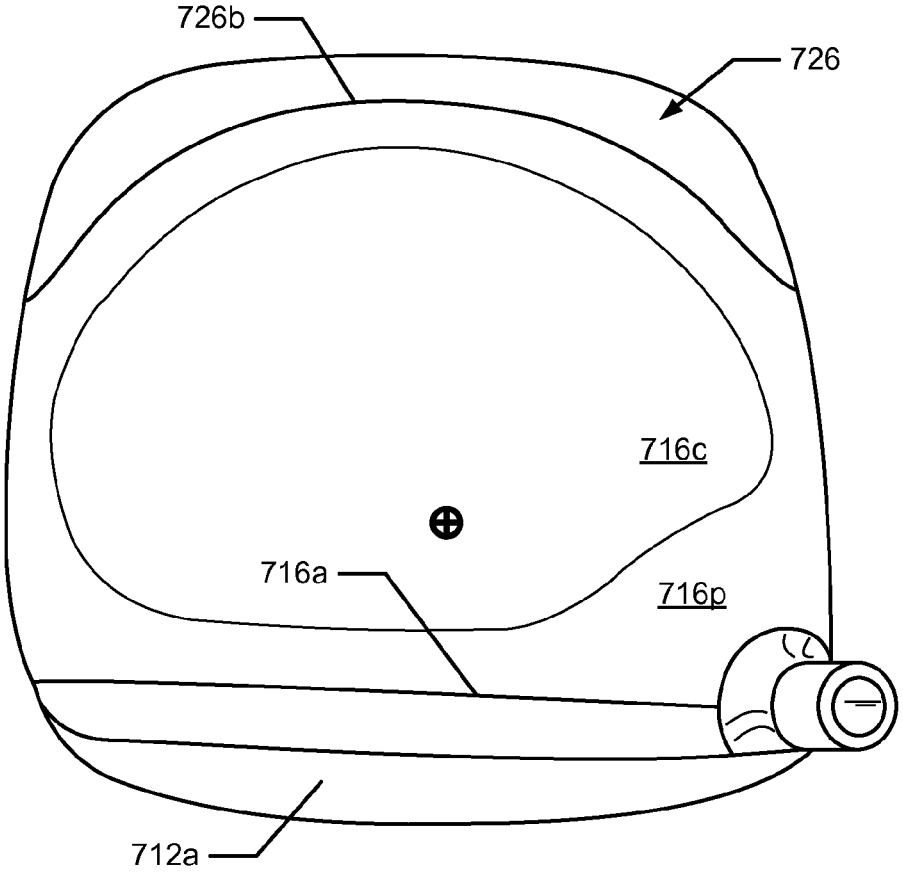
FIGS. 7A through 7D illustrate various views of a fairway wood-type golf club head and its face member in accordance with another example of this invention.
Figure 7B:
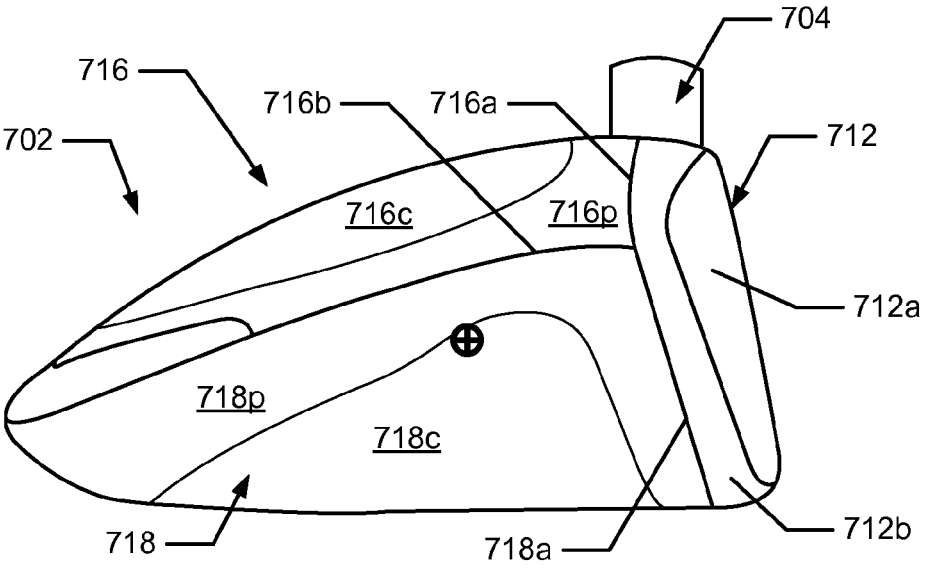

Additional examples in accordance with this invention now will be described in more detail in conjunction with FIGS. 7A through 7D. One example club head structure 702 and portions thereof are illustrated in FIGS. 7A through 7D. FIGS. 7A and 7B generally illustrate this example club head structure 702 as having a relatively square or rectangular footprint as viewed looking downward at the crown, e.g., from a ball address position. The rectangular or "squareness" characteristics of this club head 702 (and all other rectangular shaped club heads described herein) may correspond to the characteristics of other generally rectangular or square shaped golf club head structures as are known in the art, such as the characteristics described in U.S. patent application Ser. No. 11/425,737, filed Jun. 22, 2006 in the name of John T. Stites, et al. (entitled "Golf Clubs and Golf Club Heads") and U.S. patent application Ser. No. 12/141,580, filed Jun. 16, 2008 in the name of John T. Stites, et al. (entitled "High Moment of Inertia Wood-Type Golf Clubs and Golf Club Heads"), which applications are entirely incorporated herein by reference.

The club head 702 of this example structure has a multi-part construction. Specifically, this example club head structure 702 includes a cup face member 712 that has a ball striking face portion 712*a* and a return portion 712*b* extending around and rearward from a perimeter of the ball striking face portion 712*a*. While illustrated as continuous and extending from the complete perimeter of the ball striking face portion 712*a*, the return member 712*b* may be discontinuous, stepped, and/or extend different distances from various areas of the perimeter of the ball striking face portion 712*a*.

While the cup face member 712 may be made from various materials, in this specific example structure 702 the cup face member 712 is formed from a titanium alloy that is conventionally known and used in the art, and it is produced as a single piece by a forging process. Additional details of example cup face member structures 712 will be provided below. Other structures or manufacturing techniques are possible, however, without departing from the invention, such as stamping, making the face member 712 from multiple parts that are joined together, e.g., by welding or the like.

The club head 702 may further include a sole member 718 engaged with a lower portion of the return member 712*b* of the cup face member 712. In this example structure 702, the sole member 718 is a single part that forms all or substantially all of the bottom portion of the club head 702, from the face member 712 to the very rear of the club head 702. If desired, however, the sole member 718 may be made from multiple pieces that are joined together, e.g., via cements or adhesives, via mechanical connections, via releasable mechanical connections, via welding, soldering, brazing, or other fusing techniques, etc. In this illustrated example structure 702, the sole member 718 is a single titanium alloy part (e.g., a conventional alloy as is known and used in the art), made by a pressing procedure. The sole member 718 is engaged with the return portion 712*b* of the cup face 712 along seam 718*a* by a welding process. If desired, the sole member 718 further may include rib members, bends, or raised areas (internally or externally), textual information, etc., e.g., to increase its stiffness, to provide desired aesthetics or information, etc. In addition, or in place of the sole member 718, a sole with a ground-engaging surface as described above and illustrated in FIGS. 4A-6C may be used.

A crown member 716 further is provided as part of this example club head structure 702. The crown member 716 is engaged with an upper portion of the return member 712*b* of the cup face member 712. In this example structure 702, the crown member 716 forms a substantial portion of the club head top, from the face member 712 to a location near the rear of the club head 702. If desired, the crown member 716 may be made from multiple pieces that are joined together, e.g., via cements or adhesives, via mechanical connections, via releasable mechanical connections, via welding, soldering, brazing, or other fusing techniques, etc. In this illustrated example structure 702, the crown member 716, like the sole member 718, is a single titanium alloy part, made by a pressing procedure, that is engaged with the return portion 712*b* of the cup face 712 at seam 716*a* by a welding process. If desired, the crown member 716 further may include rib members, bends, or raised areas (internally or externally), textual information, e.g., to increase its stiffness, to provide desired aesthetics or information, etc.

Figure 7C:
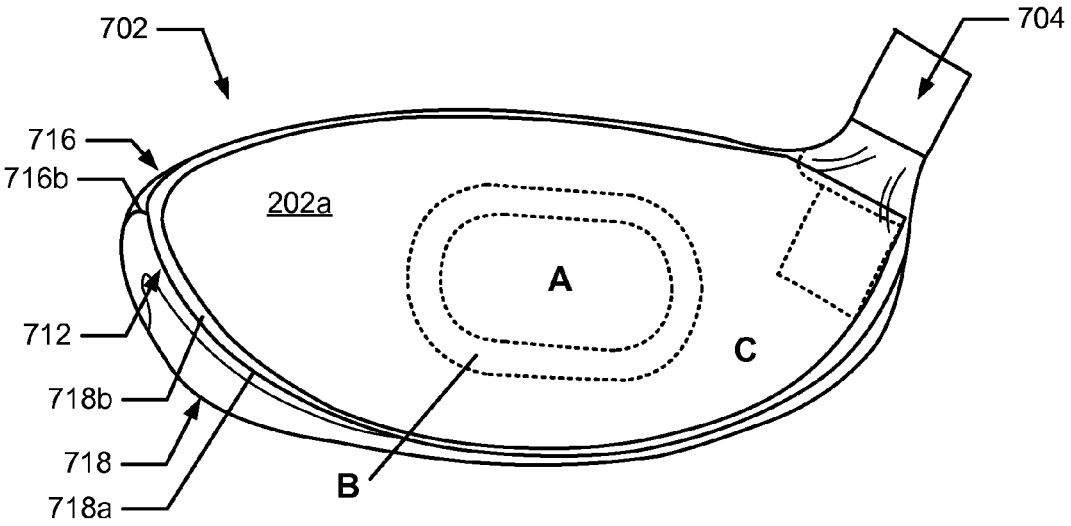

The crown member 716 and the sole member 718 of this club head structure 702 also may be engaged with one another, along seam 716*b*, as shown in FIGS. 7B and 7C. This may be accomplished in any desired manner without departing from the invention, such as via cements or adhesives, via mechanical connections, via releasable mechanical connections, via welding, soldering, brazing, or other fusing techniques, etc. In this illustrated example structure 702, the crown member 716 and the sole member 718 are engaged with one another at seam 716*b* by a welding process.

FIGS. 7A and 7B illustrate another part of this example club head structure 702, namely, the rear body member 726. The rear body member 726 of this structure 702 is engaged with the sole member 718 and the crown member 716 (at seams 726*a* and 726*b*, respectively) via a welding connection. Other connection types may be used, if desired, without departing from this invention, including, for example, cements or adhesives; mechanical connections; releasable mechanical connections; soldering, brazing, or other fusing techniques; etc. The rear body member 726 of this structure, which may be made from titanium metal or a titanium based alloy material, may be used to provide increased weight regions at the rear and/or extreme "corners" (or other desired positions) of the club head structure 702. Any desired way of increasing the weight of or the weight engaged with the rear body member 726 may be used without departing from this invention, including using a denser or thicker material as at least part of the rear body member 726, engaging a weight member with the rear body member 726 (e.g., permanently or removably), and the like. Additionally or alternatively, if desired, increased weight regions may be provided at the extreme rear and/or corner portions of the sole member 718.

Another individual part of this example club head structure 702 is illustrated in FIGS. 7A through 7C, namely, a hosel member 704 for receiving a shaft member (shaft not illustrated in FIGS. 7A through 7C). The hosel member 704 in this example structure 702 is a separate part that is engaged with one or more of the cup face member 712 or the crown member 716. Additionally or alternatively, if desired, the hosel member 704 may be engaged with the sole member 718 without departing from this invention. The hosel member 704 may take on any desired form or construction without departing from this invention. For example, some or all portions of the hosel member 704 may be located internal to the club head structure 702 (e.g., within a hollow chamber defined at least in part by members 712, 716, 718, 726). As another alternative, the hosel member 704 may be omitted, e.g., if the crown member 716 and/or the cup face member 712 include structures for securing a shaft member. In this illustrated example, the hosel member 704 is made from titanium metal or a titanium alloy material, and it is engaged with the crown member 716 and the cup face member 712 by welding processes (although other connection arrangements may be used, if desired, such as cements or adhesives; mechanical connections; releasable mechanical connections; soldering, brazing, or other fusing techniques; etc.).

Weighting characteristics can be important to providing a wood-type golf club head with desired user feel and swing characteristics, such as overall weight, moment of inertia, etc. By making some or all of the club head parts from titanium metal and/or titanium based alloys, a relatively strong and lightweight club head structure can be provided (other lightweight materials also may be used without departing from this invention, such as aluminum, aluminum alloys, magnesium, magnesium alloys, polymeric materials, reinforced carbon fiber materials, reinforced basalt fiber materials, etc.). Making the club head body parts from lightweight materials allows club designers to selectively place additional weight at desired locations in the club head structure without creating an excessively heavy golf club structure, which can lead to increased club head moment of inertia characteristics, selective club head biasing characteristics (to bias the club head to produce a right-to-left ball flight, a left-to-right ball flight, a lower trajectory, a higher trajectory, etc.), and the like. Such features also allow club head designers and club fitters to selectively place weight in the club head so as to help compensate for user swing flaws (e.g., to "draw" or "hook" bias a club head to help compensate for swing flaws that produce a slice, to "fade" or "slice" bias a club head to help compensate for swing flaws that produce a hook, etc.).

In addition to the use of the lightweight materials, golf club head structures 702 according to this invention may include other features that help reduce the weight of its parts (e.g., members 712, 716, 718). For example, FIG. 7B illustrates that the sole member 718 includes a thicker perimeter portion 718*p* that surrounds a thinner central portion 718*c*. Likewise, FIGS. 7A and 7B illustrate that the crown member 716 includes a thicker perimeter portion 716*p* that surrounds a thinner central portion 716*c*. In this manner, the overall weight of the sole member 718 and crown member 716 can be reduced (as compared to making the entire part of the same thickness as its perimeter portion) while still providing relatively thick, strong areas around the perimeters of these parts for connecting the various parts of the club head 702 together. This "weight savings" then can be selectively "repositioned" in the club head structure at other locations, as noted above. While FIGS. 7A and 7B illustrate the club head body parts 718 and 716 each as having a single thinner central region surrounded by a single and continuous (and thicker) perimeter region, the number, relative sizes, locations, dimensions, and other features of the various thick and thin regions of a club head body part may be varied without departing from this invention.

Any desired manner of reducing the thickness of the central (or other) portions of the sole and/or crown members may be used without departing from this invention. For example, the parts may be directly created in this manner, e.g., by forging, casting, or molding processes. As another example, a part may be "machined" after its initial creation to make one part of the member (e.g., the central portion) thinner than another part of the same member (e.g., the perimeter part). Any desired manner of "machining" the various members may be used without departing from this invention, including grinding, sanding, or the like. In some club head production processes, a "chemical milling" procedure will be used in which an acid material is selectively applied to the part at the desired location(s) to be thinned to thereby remove some portion of the metal or alloy (or other) material of the part at those locations. Such chemical milling procedures are conventionally known and used in various industries.

Figure 7D:
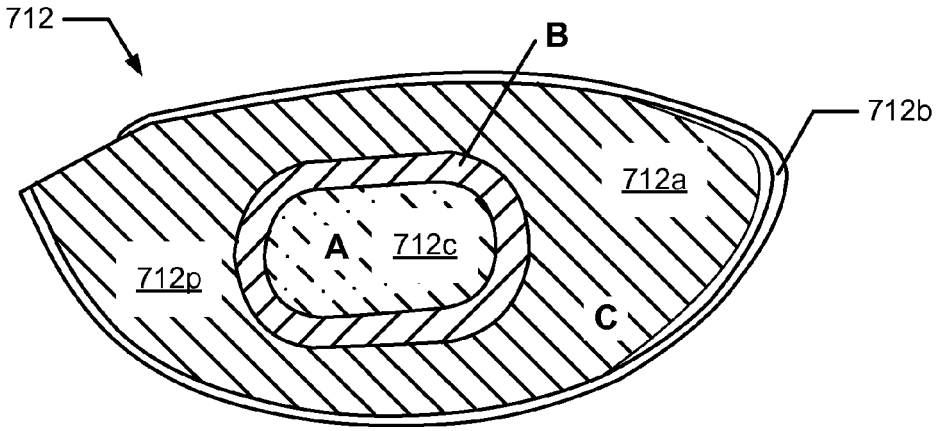

Weight savings also may be realized, in accordance with at least some example structures according to this invention, by using a variable face thickness on the ball striking face 712*a* of the club head 702. In this illustrated example, as shown in FIGS. 2C and 2D, the ball striking face 712*a* is made thicker in the central area 712*c* (region "A" in the drawings, where ball strikes typically occur) and thinner around this central area 712*c* and around the perimeter (area 712*p*) (region "C" in the drawings). A transition region located on the interior of the club head (opposite the ball striking face surface—region "B" in the drawings) gradually slopes or otherwise transitions the face thickness between the thicker central region 712*c* and the thinner perimeter region 712*p*. The variable face thickness may be advantageous in that it provides a thick, strong face at the location of typical ball strikes while providing a relatively thin and/or flexible perimeter (to increase the club head's coefficient of restitution or "COR"). Club heads in accordance with examples of this invention may have any desired COR value, including at least 0.75, at least 0.8, at least 0.81, at least 0.82, at least 0.83, or even higher. Also, while FIGS. 7C and 7D illustrate a single thicker face portion 712*c* on the ball striking face 712*a* (substantially centrally located on the ball striking face 712*a* (surrounded by a single, continuous, thinner perimeter region)), the number, relative sizes, locations, dimensions, and other features of the various thick and thin regions of a ball striking face 712*a* may be varied without departing from this invention.

The following Table provides various characteristics that may be included in golf club head structures like structures 702 described above in conjunction with FIGS. 7A through 7D:

TABLE 1

Various Club Head Characteristics - General Ranges

| Club Head Characteristic | Range of Values |
|---|---|
| Length (Maximum Heel to Toe Dimension) | 4 to 6 inches |
| Breadth (Maximum Front to Back Dimension) | 4 to 6 inches |
| Height (Maximum Sole to Crown Dimension) | 1 to 3.5 inches |
| Volume (Club Head) | At Least 380 cc |
| Loft Angle | 12 to 32° |
| Coefficient of Restitution | At Least 0.75 |
| Moment of Inertia - Izz | at least 4000 g-cm$^2$ |
| Club Length | 37 to 43 inches |
| Weight | 170 to 250 g |

Some club head structures in accordance with examples of this invention will have characteristics as described in the following Table:

TABLE 2

Various Club Head Characteristics - Ranges of Values

| Club Head Characteristic | Range of Values |
|---|---|
| Length (Maximum Heel to Toe Dimension) | 4.5 to 5.5 inches |
| Breadth (Maximum Front to Back Dimension) | 4.5 to 5.5 inches |
| Height (Maximum Sole to Crown Dimension) | 1.25 to 3 inches |
| Volume (Club Head) | At Least 400 cc |
| Loft Angle | 16 to 28° |
| Coefficient of Restitution | At Least 0.8 |
| Moment of Inertia - Izz | at least 4200 g-cm$^2$ |
| Club Length | 37 to 43 inches |
| Weight | 180 to 240 g |

Even more narrow ranges of characteristics of club head structures in accordance with at least some examples of this invention are provided in the following Table:

TABLE 3

Various Club Head Characteristics - Ranges of Values

| Club Head Characteristic | Range of Values |
|---|---|
| Length (Maximum Heel to Toe Dimension) | 4.5 to 5 inches |
| Breadth (Maximum Front to Back Dimension) | 4.5 to 5 inches |
| Height (Maximum Sole to Crown Dimension) | 1.5 to 2.5 inches |
| Volume (Club Head) | At Least 420 cc |
| Loft Angle | 18 to 28° |
| Coefficient of Restitution | At Least 0.82 |
| Moment of Inertia - Izz | at least 4500 g-cm$^2$ |
| Club Length | 37 to 43 inches |
| Weight | 185 to 230 g |

If desired, club heads in accordance with at least some examples of this invention may approach the maximum dimensions, maximum volume, and maximum COR characteristics currently allowed by the Rules of Golf as set forth by the United States Golf Association.

Large size golf club heads in accordance with examples of this invention, e.g., of the type illustrated in FIGS. 7A through 7D and described in the tables above, may have moment of inertia (Izz) characteristics of at least 4700 g-cm$^2$. Specific club head structures may have Izz values of at least 4800 g-cm$^2$, at least 5000 g-cm$^2$, and even at least 5900 g-cm$^2$. Such club heads may have overall dimensional sizes approaching the USGA maximum limits (e.g., an overall length and breadth of at least 4.5 inches and an overall volume of at least 450 cc, and in some examples, length dimensions of at least 4.75 inches and volumes of about 460 cc). Such club heads may have dimensions, for example, similar to the overall dimensions of commercially available Sumo 5900™ golf club products available from NIKE, Inc. of Beaverton, Oreg.

As illustrated in FIGS. 7C through 7D, the ball striking face 712*a* includes a thicker central portion 712*c* (region "A") and a thinner perimeter portion 712*p* (region "C"). These thicker and thinner portions may have a wide variety of shapes, sizes, locations (with respect to the club head face) and thickness differentials without departing from this invention.

As described above, various parts of golf club head structures in accordance with examples of this invention (e.g., the face, sole, crown, and rear members) may be joined together by various methods, such as through the use of cements or adhesives; mechanical connectors, optionally releasable mechanical connections; and/or welding, soldering, brazing, or other fusing techniques. If desired, a finish may be applied over to conceal the area where the parts are joined together (e.g., paint, chrome or other metal plating, polymeric coatings, etc.).

Golf club heads in accordance with at least some examples of this invention, e.g., as specifically described above, may have high moment of inertias, particularly about a vertical axis passing through the center of gravity (Izz). The use of strong and lightweight materials in some or all of the club head parts, such as titanium and titanium alloys (e.g., VL-Ti in the cup face component, KS120 titanium alloy in the crown and/or sole components, or other titanium alloys conventionally used in golf club head construction), and the use of selective machining techniques to produce precisely located thinned areas, such as chemical etching, produce substantial weight savings and allow club head designers to selectively place weight at desired locations to affect club head properties and/or ball flight characteristics (e.g., to fade or draw bias the club, etc.). The overall head weight (e.g., at least about 190 grams or even about 200 grams for the metal parts) provides a relatively heavy head weight to promote high swing speeds. Moreover, the multiple-thickness cup face described above provides improved ball speed over a larger area of the ball striking face.

Many modifications to the overall club head structures and/or the overall golf club structures may be made without departing from this invention. For example, many modifications may be made to the part or parts making up the club head structures, to the materials used in making the club head structures, to the manner in which the parts of the club head structures are joined together, etc. Also, many modifications may be made to the thickness, weight, shape, size, and/or other physical characteristics of the part or parts making up the overall golf club structure, etc. Further modifications may be made in the manner in which the club head and its associated parts are made, including modifications in the specific processes used to make the parts, modifications in the materials used to make the parts, modifications to the order in which the parts are made and the club head is assembled, and the like.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A fairway wood-type golf club, comprising:

a fairway wood-type golf club head including:

a club head body including a heel portion, a toe portion, a crown portion, a sole portion, and a rear portion, and a ball striking face having a variable face thickness, wherein the ball striking face is engaged with or integrally formed as part of the club head body extending from the toe portion to the heel portion, and further wherein the ball striking face has a central region having a first face thickness, a perimeter region having a second face thickness thinner than the first face thickness, and at least one transition region at least partially transitioning from the first face thickness to the second face thickness, wherein the transition region is located on an interior of the club head opposite the ball striking face and the transition region gradually slopes and transitions the face thickness between the thicker central region and the thinner perimeter region, wherein the club head body and the ball striking face define a volume, a hosel member engaged with at least a portion of the club head; and a shaft member engaged with the hosel member, wherein the ball striking face includes a loft angle defined as an angle of the ball striking face in relation to the shaft member, wherein the volume is in a range between 300 cc and 460 cc and the loft angle is in a range between 15 and 28 degrees, wherein the sole portion includes a front surface, a central surface, and a rear surface;

wherein the front surface is angled upward toward the lower edge of the ball striking face, the central surface is generally horizontal, and the rear surface is angled upward toward the rear edge of the golf club body;

wherein the sole has a low point near the central surface and angles upward from the low point in the heel direction and the toe direction.

2. A fairway wood-type golf club according to claim 1, wherein the loft angle is between 20 and 25 degrees.

3. A fairway wood-type golf club according to claim 2, wherein the club head has a volume of 460 cc.

4. A fairway wood-type golf club according to claim 1, the loft angle is between 18 and 28 degrees.

5. A fairway wood-type golf club according to claim 1, wherein the club head has a maximum length dimension from the heel portion to the toe portion that ranges from 4 to 6 inches, wherein the club head has a maximum breadth dimension from the ball striking face to the rear portion that ranges from 4 to 6 inches, wherein the club head has a maximum height dimension from the sole portion to the crown portion that ranges from 1 to 3.5 inches, wherein the club head has a coefficient of restitution of at least 0.75, wherein the club head has a moment of inertia Izz of at least 4000 g-cm$^2$, and wherein the club head has a weight that ranges from 170 to 250 grams.

6. A fairway wood-type golf club according to claim 1, wherein the club head has a maximum length dimension from the heel portion to the toe portion that ranges from 4.5 to 5.5 inches, wherein the club head has a maximum breadth dimension from the ball striking face to the rear portion that ranges from 4.5 to 5.5 inches, wherein the club head has a maximum height dimension from the sole portion to the crown portion that ranges from 1.25 to 3 inches, wherein the club head has a volume of at least 400 cc, wherein the loft angle is between 16 and 28 degrees, wherein the club head has a coefficient of restitution of at least 0.80, wherein the club head has a moment of inertia Izz of at least 4200 g-cm$^2$, and wherein the club head has a weight that ranges from 180 to 240 grams.

7. A fairway wood-type golf club according to claim 1, wherein the club head has a maximum length dimension from the heel portion to the toe portion that ranges from 4.5 to 5 inches, wherein the club head has a maximum breadth dimension from the ball striking face to the rear portion that ranges from 4.5 to 5 inches, wherein the club head has a maximum height dimension from the sole portion to the crown portion that ranges from 1.5 to 2.5 inches, wherein the club head has a volume of at least 420 cc, wherein the loft angle is between 18 and 28 degrees, wherein the club head has a coefficient of restitution of at least 0.82, wherein the club head has a moment of inertia Izz of at least 4500 g-cm$^2$, and wherein the club head has a weight that ranges from 185 to 230 grams.

8. A fairway wood-type golf club according to claim 1, wherein a majority of the club head body is constructed from at least one member selected from the group of: titanium metal or titanium-containing alloy materials.

9. A fairway wood-type golf club according to claim 1, wherein a weight member is located proximate to a rear heel location of the sole portion.

10. A fairway wood-type golf club according to claim 1, wherein a weight member forming a portion of a crown surface is located proximate to a rear location of the crown portion.

11. A fairway wood-type golf club, comprising:

a fairway wood-type golf club head including:

a club head body including a heel portion, a toe portion, a crown portion, a sole portion, and a rear portion, and a ball striking face engaged with or integrally formed as part of the club head body, and wherein the ball striking face has a variable thickness, and further wherein the ball striking face has a first area having a first thickness, a second area having a second thickness, and at least one transition region at least partially transitioning from the first thickness to the second thickness, and wherein the club head body and the ball striking face define a volume, a shaft member engaged with the club head, wherein the ball striking face includes a loft angle defined as an angle of the ball striking face in relation to the shaft member, wherein the club head has a moment of inertia Izz of at least 5000 g-cm$^2$ and wherein the club has a coefficient of restitution of at least 0.80, and wherein the volume is in a range between 400 cc and 460 cc and the loft angle is in a range between 15 and 28 degrees, and wherein the sole portion includes a ground-engaging surface, wherein the ground-engaging surface has a keel formed of a plurality of substantially planar surfaces oriented at transverse angles to each other, wherein all planar surfaces converge at a convergence point located near a center of the sole portion in a heel to toe direction and a front to back direction.

12. A fairway wood-type golf club according to claim 11, wherein the club head has a moment of inertia Izz of at least 5500 g-cm$^2$.

13. A fairway wood-type golf club according to claim 11, wherein the club head has a moment of inertia Izz of at least 5900 g-cm$^2$.

14. A fairway wood-type golf club according to claim 11, wherein the club head has a volume of 460 cc.

15. A fairway wood-type golf club according to claim 14, wherein the loft angle is between 20 and 25 degrees.

16. A fairway wood-type golf club according to claim 11, wherein the club head body constitutes a multi-part construction.

17. A fairway wood-type golf club according to claim 11, wherein a majority of the club head body is constructed from at least one member selected from the group of: titanium metal or titanium-containing alloy materials.

18. A fairway wood-type golf club according to claim 11, wherein a majority of the ball striking face is constructed from at least one member selected from the group of: titanium metal or titanium-containing alloy materials.

19. A fairway wood-type golf club according to claim 11, wherein a center thickness on the sole portion is less than a perimeter thickness on the sole portion.

20. A fairway wood-type golf club according to claim 11, wherein the plurality of planar surfaces is defined by four planar surfaces that include two front surfaces extending rearward from a bottom edge of the ball striking face and two rear surfaces extending toward the a heel portion and the a toe portion of the club head body.

21. A fairway wood-type golf club, comprising:

a fairway wood-type golf club head including:

a club head body including a heel portion, a toe portion, a crown portion, a sole portion, and a rear portion, and a ball striking face having a variable face thickness, wherein the ball striking face is engaged with or integrally formed as part of the club head body extending from the toe portion to the heel portion, and further wherein the ball striking face has a central region having a first face thickness, and a perimeter region having a second face thickness thinner than the first face thickness, and wherein the club head body and the ball striking face define a volume;

a hosel member engaged with at least a portion of the club head; and a shaft member engaged with the hosel member, wherein the ball striking face includes a loft angle defined as an angle of the ball striking face in relation to the shaft member, wherein the club head has a maximum length dimension from the heel portion to the toe portion that ranges from 4.5 to 5.5 inches, wherein the club head has a maximum breadth dimension from the ball striking face to the rear portion that ranges from 4.5 to 5.5 inches, wherein the club head has a maximum height dimension from the sole portion to the crown portion that ranges from 1.25 to 3 inches wherein the club head has a coefficient of restitution of at least 0.80, wherein the club head has a moment of inertia Izz of at least 4200 g-cm$^2$, and wherein the club head has a weight that ranges from 180 to 240 grams, and wherein the volume is in a range between 400 cc and 460 cc and the loft angle is in a range between 15 and 28 degrees;

wherein the sole portion includes a front surface, a central surface, and a rear surface;

wherein the front surface is angled upward toward the lower edge of the ball striking face, the central surface is generally horizontal, and the rear surface is angled upward toward the rear edge of the golf club body;

wherein the sole has a low point near the central surface and angles upward from the low point in the heel direction and the toe direction.

22. A fairway wood-type golf club, comprising:

a fairway wood-type golf club head including:

a club head body including a heel portion, a toe portion, a crown portion, a sole portion, and a rear portion, and a ball striking face having a variable face thickness, wherein the ball striking face is engaged with or integrally formed as part of the club head body extending from the toe portion to the heel portion, and further wherein the ball striking face has a central region having a first face thickness, and a perimeter region having a second face thickness thinner than the first face thickness, and wherein the club head body and the ball striking face define a volume;

a hosel member engaged with at least a portion of the club head; and a shaft member engaged with the hosel member, wherein the ball striking face includes a loft angle defined as an angle of the ball striking face in relation to the shaft member;

wherein the club head has a maximum length dimension from the heel portion to the toe portion that ranges from 4.5 to 5 inches, wherein the club head has a maximum breadth dimension from the ball striking face to the rear portion that ranges from 4.5 to 5 inches, wherein the club head has a maximum height dimension from the sole portion to the crown portion that ranges from 1.5 to 2.5 inches, wherein the club head has a coefficient of restitution of at least 0.82, wherein the club head has a moment of inertia Izz of at least 4500 g-cm$^2$, and wherein the club head has a weight that ranges from 185 to 230 grams, and wherein the volume is in a range between 420 cc and 460 cc and the loft angle is in a range between 20 and 25 degrees; and wherein a weight member forming a portion of a crown surface is located proximate to a rear location of the crown portion.

* * * * *